US009388543B2

(12) United States Patent
Cacciotti

(10) Patent No.: US 9,388,543 B2
(45) Date of Patent: Jul. 12, 2016

(54) MULTI-PURPOSE TRUCK FOR RE-ESTABLISHMENT OF SAFE AND PRACTICABLE ROAD CONDITIONS AFTER CAR ACCIDENTS, THROUGH CLEANING OF THE ROAD PLATFORM

(75) Inventor: Angelo Cacciotti, Rome (IT)

(73) Assignee: Sicurezza e Ambiente S.p.A., Rome (IT)

( * ) Notice: Subject to any disclaimer, the term of this patent is extended or adjusted under 35 U.S.C. 154(b) by 718 days.

(21) Appl. No.: 13/821,419

(22) PCT Filed: Sep. 7, 2011

(86) PCT No.: PCT/EP2011/065505

§ 371 (c)(1),
(2), (4) Date: Aug. 19, 2013

(87) PCT Pub. No.: WO2012/032101

PCT Pub. Date: Mar. 15, 2012

(65) Prior Publication Data

US 2013/0318739 A1 Dec. 5, 2013

(30) Foreign Application Priority Data

Sep. 8, 2010 (EP) ..... 10425291

(51) Int. Cl.
*E01H 1/10* (2006.01)
*E01H 1/00* (2006.01)

(52) U.S. Cl.
CPC ..... *E01H 1/103* (2013.01); *E01H 1/001* (2013.01)

(58) Field of Classification Search
CPC ... E01H 1/0836; E01H 1/0863; E01H 1/0827; E01H 1/103; E01H 8/105; E01H 1/00; E01H 1/02
See application file for complete search history.

(56) References Cited

U.S. PATENT DOCUMENTS 5,596,788 A * 1/1997 Linville ..... E01H 1/047 15/340.1
6,182,328 B1 * 2/2001 Roden ..... A47L 11/34 15/321

(Continued)

FOREIGN PATENT DOCUMENTS

EP 2133474 A2 12/2009
EP 2428284 A1 3/2012
EP 2428285 B1 3/2013

OTHER PUBLICATIONS

Partial European Search Report/Annex to European Search Report for EP 2428284A1.

(Continued)

*Primary Examiner* — Robert Scruggs
(74) *Attorney, Agent, or Firm* — Oppenhuizen Law PLC; David L. Oppenhuizen

(57) ABSTRACT

A Multi-purpose truck for re-establishment of safe and practicable road conditions, after car accidents, through cleaning of the road platform, said truck being equipped by: several tanks, a high-pressure water gun for spraying cleaning products, a suction system suitable to remove, from the road platform, an emulsion that results from the addition of cleaning products to the debris on the road platform, and tanks containing the resulting emulsion to be temporarily stocked at a location, before being definitely delivered to special and authorized plants for disposal. The power supply, necessary to make the multi-purpose truck work properly, can be directly provided by the engine of the truck and/or any other point of energy transmission in the kinematic chain, or it can be directly provided by a pneumatic circuit previously installed on the same truck. The extracted energy can be used as a power supply for mechanical, electrical, or hydraulic devices.

13 Claims, 3 Drawing Sheets

(56) References Cited

U.S. PATENT DOCUMENTS

2005/0120505 A1* 6/2005 Tani ..... G08B 13/19658 15/319
2007/0095370 A1* 5/2007 Kratser ..... B08B 3/02 134/105
2007/0262180 A1 11/2007 Adams
2010/0196129 A1* 8/2010 Buckner ..... E02F 3/94 414/467

OTHER PUBLICATIONS

International Search Report for PCT/EP2011/0655505.

* cited by examiner

MULTI-PURPOSE TRUCK FOR RE-ESTABLISHMENT OF SAFE AND PRACTICABLE ROAD CONDITIONS AFTER CAR ACCIDENTS, THROUGH CLEANING OF THE ROAD PLATFORM

CROSS REFERENCE TO RELATED APPLICATIONS

This patent application is a national phase entry under 35 U.S.C. §371 of PCT International Patent Application PCT/EP2011/065505, filed Sep. 7, 2011, designating the United States and published in English as International Patent Publication WO/2012/032101 on May 15, 2012, which claims the benefit, under Article 8 of the PCT, of European Patent Application Ser. No. 10425291.1, filed Sep. 8, 2010, the benefit and entire disclosure of each of which is hereby incorporated herein by this reference.

FIELD OF THE INVENTION

The present invention relates to a multi-purpose truck that is specifically equipped in order to provide the best support in the activities for re-establishment of safe and practicable road conditions, after car accidents.

BACKGROUND OF THE INVENTION

The multi-purpose truck is able, using some special devices installed on it, to support the re-establishment of safe traffic conditions and to prevent, even in relevant accidents, any damage to the environment. This is possible because it supports the cleaning of the road platform and the aspiration of functional polluting liquids (lubricating oils, fuels, cooling liquids, etc.) eventually lost by vehicles involved in the accident. Further, the road platform is subject to a treatment under specific products, so that any slippery surface is avoided, and the solid debris related to typical car equipments (broken glasses, parts made of plastic, metals, remaining parts of structures, etc.) is removed.

The interventions associated with cleaning the road platform in larger accidents are supported by different multi-purpose vehicles, more exactly the multi-purpose vans and the multi-purpose top trucks, as described in their technical aspects in a previous European patent EP 09007776 filed by the same undersigned applicant. Another multi-purpose motor vehicle has entered in the group of the above special vehicles, and this motor vehicle is able to support the usual road interventions and the re-establishment of safe traffic conditions after car accidents.

Indeed, these vehicles can support the interventions, addressed to re-establish safe traffic conditions and to prevent any damage to the environment, on most of the road accidents, because they are equipped with special devices providing a jet of water solution and other devices having a high aspiration power, further containing specific products able to remove any slippery condition of surfaces, like the ecological surfactant and the molecular chain destroyer; these special devices can further collect and contain a large quantity of solid debris lost by vehicles involved in the accidents; and the above emergency vehicles can reach the site of accidents very quickly.

It is here remarked how these vehicles, equipped with a suction system and a pressure water gun, both working with electric power supply, require the installation on board of a 7-8 Kw electric energy generator, having a relevant weight and size.

During the design of the multi-purpose truck, these technical problems have been subject of a specific study, and the final choice has been to avoid devices requiring electric power supply, or requiring compressed air supply, that have as a consequence a short operative autonomy. Both the above solutions have resulted to be not compatible with this type of vehicles, especially with reference to the typical weight of an electric generator and its large size. Another solution is disclosed in document US 2007/0095370A1 where the truck engine provides the energy to the devices.

BRIEF SUMMARY OF THE INVENTION

Therefore, the main objective of the present invention is to avoid all the above said drawbacks, and to obtain a technical system that is autonomous, and can work for a long time depending only on the quantity of the available fuel.

Further particular and specific features of the multi-purpose truck—having two or three, symmetric or asymmetric wheels, powered by a combustion, electric, or hybrid engine—are the following:

- design of the previous suction and pressure water jet systems, so that they are integrated and optimized, they are efficient and take as little space as possible, so that they can be carried and used in a very comfortable way; the pressure water jet system can be used as a fire extinguisher, because the products used stop the combustion in a very quick and efficient way, due to a bio-chemical isolation process of the fuel with respect of to the air oxygen (oxidizing agent);
- emergency signaling, to be placed at a specific distance from the obstacle on the road, so that it alerts the incoming drivers and protects the workers involved in the cleaning operations of the road platform, comprising:
  - an acoustic alarm device, activated by a proximity sensor, for a time of 10 seconds, when a vehicle is approaching the area;
  - at least four visual signaling devices, having a yellow blinking light, to be placed on ground, in order to signal the obstacle on the road, in case of night intervention or low visibility conditions;
  - a visual signaling device, having a yellow blinking light, installed on the multi-purpose truck, otherwise having a blue blinking light, in case it is recognized as a fire extinguishing vehicle by the Italian Ministry of Transportation and Facilities, Department of Terrestrial Transportations;
- apparatus including computing means and means for a real time communication with an operative Headquarter, said apparatus embedding functions of:
  - driving the operator to the exact site of accident, according to the quickest route;
  - immediate recognition of the risk factor of the event, according to detection of R.I.N. codes (Risk Identification Number) and O.N.U. codes (related to the identification of the product);
  - communication to the operative Headquarter of the need for a special intervention by skilled operators available on the territory, especially in case of accidents involving products, materials or substances that are dangerous, infective and/or toxic;
  - transmission to the operative Headquarter of digital images related to the accident, so that workers of the same Headquarter can understand exactly the situation and can make the proper decisions;

reporting the completed activities of intervention, with storage of the technical and photographic documents related to the accident;

communication to the operative Headquarter of the current geographic position of the truck, so that it can be visually represented on each terminal or on a main screen, and can give a constantly updated reference of the operative situation in a specific national area;

and embedding the additional function of:

providing supervision and control, or remote control, of intervention devices on truck, like i.e. high-pressure water gun, suction systems, emergency signaling means, and other devices for pulling and/or lifting vehicles;

special lighting apparatus to be used in the operative area;

printer, so that a copy of the filled form, according to the called "Transparent project", can be released including all data related to the road accident;

medical emergency material, like i.e.: medical emergency box; first aid medicines; defibrillator (all the operators are skilled because they have followed courses of first medical aid, and use of defibrillator, at qualified medical Institutions); a small oxygen cylinder for asthmatic people; thermic cover; a bottle of water, etc.;

special equipment of the multi-purpose truck, including boxes obtained from the structure, said boxes being partitioned and prepared as respective housings of portable devices or containers of debris having a specific size; and the operators work in comfortable and safe driving conditions; with further protection during the intervention with respect to the other incoming vehicles.

Therefore, it is specific subject of the present invention a multi-purpose truck for re-establishment of safe and practicable road conditions, after car accidents, through cleaning of the road platform, said truck being equipped by:

three tanks, made of any type of material and having any shape and size: the first containing clean water; the second containing water mixed to a special washing liquid (ecological surfactant) and a special treatment liquid for the road platform (so called molecular chain destroyer, to be sprayed on oil and related oil products); the third containing emulsion obtained by washing the road platform;

a high-pressure water gun, including a rain jet adjustment, providing a jet of the above said solution on the road platform, where polluting functional liquids (lubricating oils, fuels, cooling substances, etc.) have been eventually lost;

a suction system suitable to remove, from the road platform, the above resulting emulsion, obtained from polluting materials mixed with the washing/treatment solution; furthermore, solid and not biodegradable debris are removed/aspirated, these debris being related to the typical car equipment (broken glasses, parts made of plastic, metals, remaining parts of structures, etc.);

tanks containing the resulting emulsion and the removed solid remaining parts, to be temporarily stocked at the site of the company that made the intervention, before being definitely delivered to special and authorized plants, where they are processed and finished according to specific operative procedures with respect to the existing environmental laws, characterized in that:

the power supply, necessary to make the multi-purpose truck working properly, can be directly provided by the engine and/or any other point of energy transmission in the kinematic chain, otherwise it can be directly provided by a pneumatic circuit previously installed on the same truck; the extracted energy can be therefore used as a power supply for mechanical, electrical or hydraulic devices.

BRIEF DESCRIPTION OF THE SEVERAL VIEWS OF THE DRAWING

The present invention will now be described for illustrative but not limitative purposes, according to its preferred embodiments, with particular reference to figures of the enclosed drawings, wherein.

DETAILED DESCRIPTION

It is here underlined that, in the following, only some of the many conceivable embodiments of the present invention will be described, and that they are just some particular examples that do not introduce any limitations, having the possibility to describe many other embodiments based on the disclosed technical solutions of the present invention.

Figure 1:
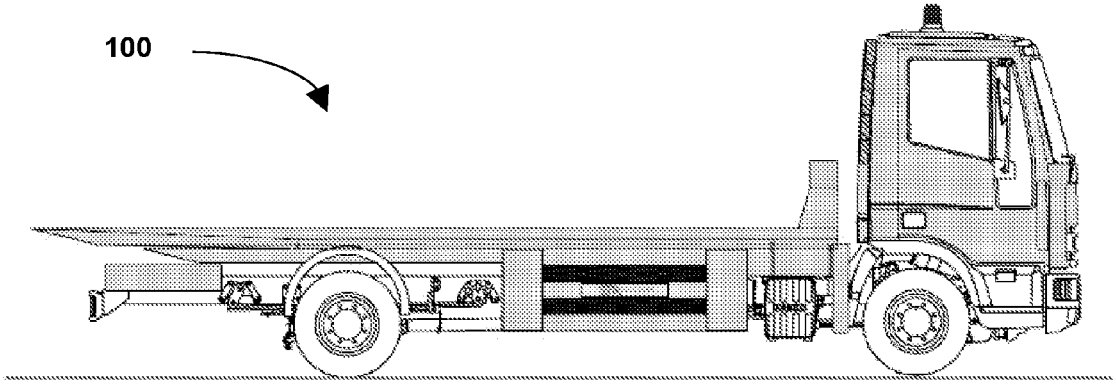
FIG. 1 is a lateral view of a first example of a multi-purpose truck, as a vehicle of support to activities for re-establishment of safe and practicable road conditions, after car accidents.
Figure 2:
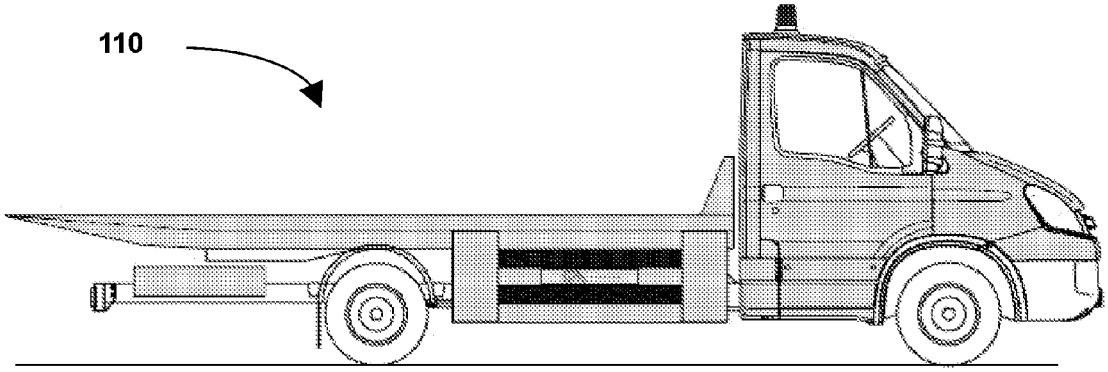
FIG. 2 is a lateral view of a second example of a multi-purpose truck, as a vehicle of support to activities for re-establishment of safe and practicable road conditions, after car accidents.

In FIGS. 1-2 two respective examples are illustrated regarding respective trucks 100 and 110 supporting the activities of re-establishment of safe and practicable road conditions, through "cleaning" parts of the road platform involved in a car accident. "Cleaning" means aspiration and collection of liquids and other polluting materials, eventually lost by vehicles, like i.e. lubricating oils, fuels, parts of vehicles and other types of debris.

In particular cases, the intervention can involve the treatment of dangerous goods, hazard substances, and industrial wastes transported on the same vehicles involved in the accident. In these situations, the intervention will be managed by companies of specialists having all the certificates and skills required by law, usually operative partners of the intervention network.

In fact, multi-purpose trucks 100 and 110 are part of a national intervention network that includes different type of vehicles, like, i.e. the multi-purpose vans, the multi-purpose top trucks, and the multi-purpose motor vehicle, chosen according to the type and extension of the accident.

This network is coordinated by an operative Headquarter that receives all the intervention calls coming from all around the national territory. The requests are received directly, through an Italian toll free phone number "800.014.014", that is active 24 hours per day, 365 days per year. When a telephone call arrives, related to an accident, a worker of the Headquarter calls the local operator and ask him to go urgently on site, and to start as soon as possible the activities of re-establishment of normal road conditions, through cleaning of the road platform.

Figure 3:
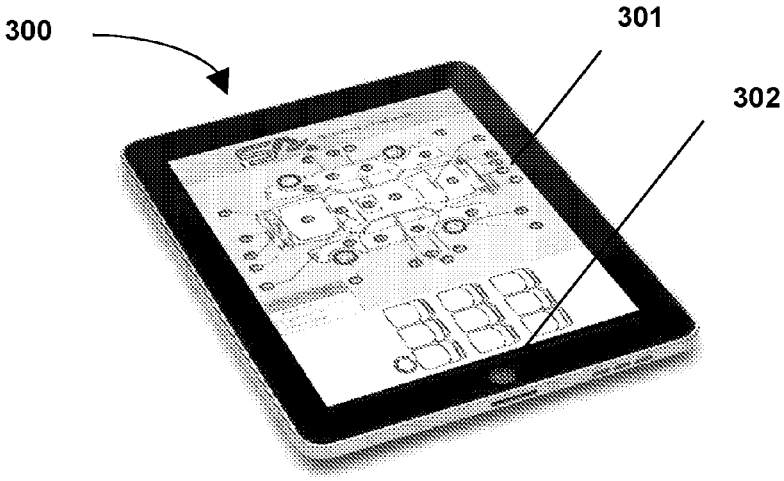
FIG. 3 is a perspective view of a tablet PC, available in the same trucks of previous FIGS. 1-2, that provides to an operator a remote control of intervention devices, and a real time communication with an operative Headquarter.

During the travel, the same operator has some computing means available on his truck 100, like i.e. the tablet PC 300 of FIG. 3, connected to the operative Headquarter through the national mobile telephone network, or the satellite or wireless telecommunication networks. As an alternative, the computing means can be represented by personal computers, PDAs, or mobile phones of the latest generation, able to send/receive digital photos and digital videoclips.

The tablet PC 300 has a special navigation system, installed inside, connected to a data base containing detailed maps with indications of the best way to reach any destination in the shortest possible time. When the operator arrives on site of accident, he has the first duty of recognizing exactly the nature of materials and eventual chemical substances to be treated and/or removed, so that he can implement the proper recovering methods in cooperation with personnel of the Headquarter.

In order to reach this goal, the operator uses the same tablet PC 300, available in said truck 100, connected to a data base containing:

- list of dangerous goods, with reference to their chemical-physical features and their proper handling procedures, with respect to possible events of leakage, fire, or environmental dispersion (R.I.N. code—Risk Identification Number, former Kemler, and O.N.U. code related to the identification of the product);

The same data base is available to the operative Headquarter and further comprises information about:

- position, on national territory, of industrial structures able to operate and handle dangerous transported goods, in order to prevent further relevant disasters;
- list of plants, associated to class of environmental risk, so that it is possible to find, as soon as possible, at any place on the national territory, the closest to the place of accident, the same plants being able to provide production, treatment or storage of that specific dangerous materials, for which the intervention has been requested.

The communication between local operator and operative Headquarter can be integrated with audio/video clips, e-mails, digital photos, etc., everything transmitted in real time, using the same tablet PC 300 available on truck 100.

Figure 5:
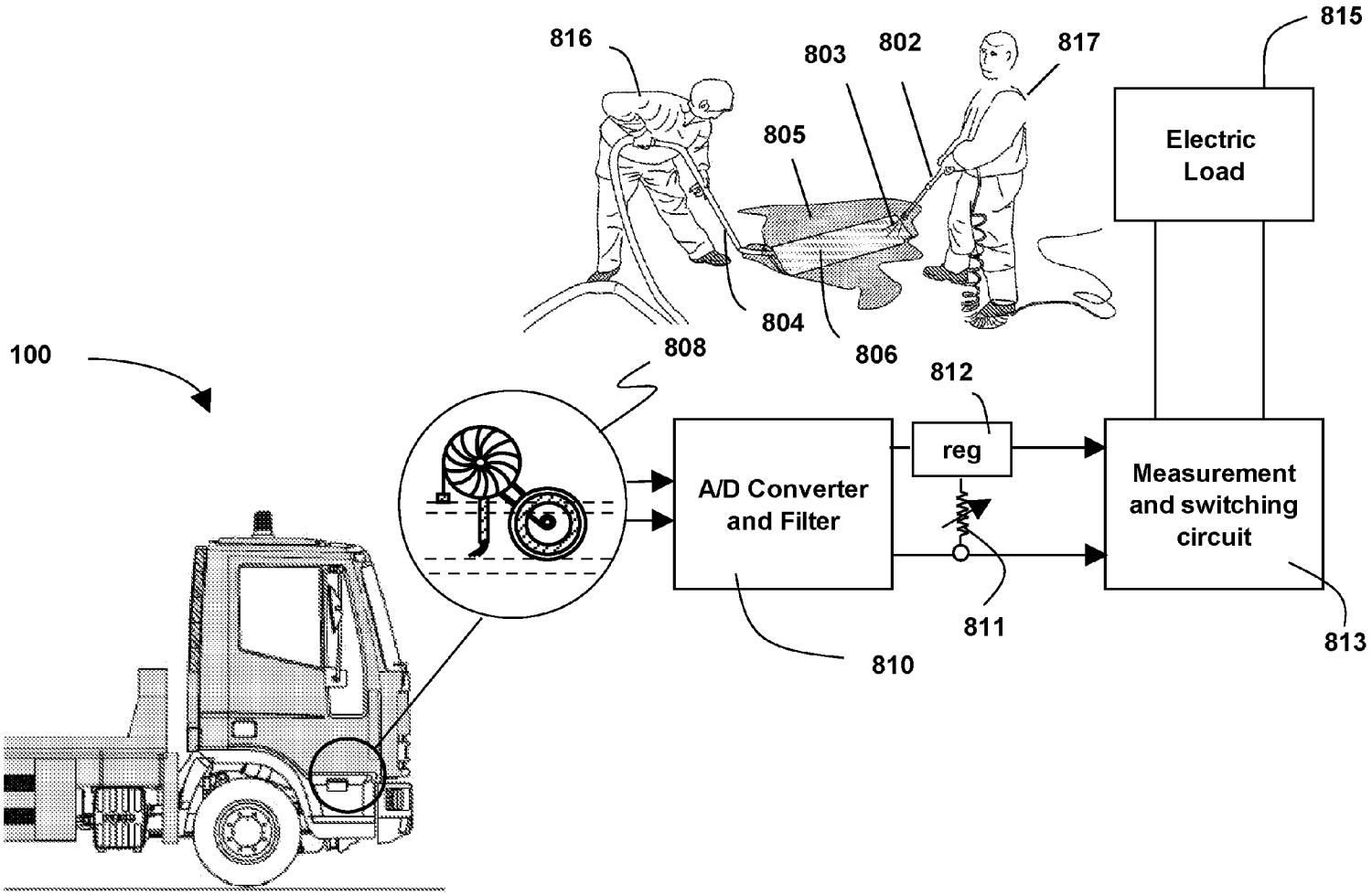
FIG. 5 is a view of a block diagram that represents an electric circuit working as a power supply of a high-pressure water gun device, and a device for fast aspiration of liquids, both installed on trucks of FIGS. 1-2.

With reference to FIG. 5, the multi-purpose truck 100 comprises as basic elements:

- tanks containing: clean water; water mixed to a special washing liquid (ecological surfactant) and a special treatment liquid for the road platform (so called molecular chain destroyer, to be sprayed on oil and related oil products) 803; emulsion obtained by collection of the washing/treatment liquids and the polluting oil materials;
- a high-pressure water gun, including a rain jet adjustment, 802 providing a jet of the above said solution on the road platform, where polluting functional liquids (lubricating oils, fuels, cooling substances, etc.) have been eventually lost by vehicles as a consequence of car accidents or breakdown;
- a suction system 804 suitable to remove, from the road platform, the above resulting emulsion 806, obtained from polluting materials mixed to the washing/treatment solution 803; furthermore, solid and not biodegradable debris are removed/aspirated, these debris being related to the typical car equipment (broken glasses, parts made of plastic, metals, remaining parts of the structures, etc.) 805;
- tanks containing the resulting emulsion 806 and the removed solid remaining parts, to be temporarily stocked at the site of the company that made the intervention, before being definitely delivered to special and authorized plants, where they are processed and finished according to specific operative procedures with respect to the existing environmental laws.

Once the connection pipes are installed, connecting the terminal devices of the hydraulic circuit to respective independent tanks, placed on vehicle 100, the operator 816 (eventually assisted by a second operator 817) can start the operations of cleaning the road platform and related parts invaded by polluting liquids and/or other not biodegradable materials. As a priority, the same operator 816 will remove immediately, using the suction system 804, most of the existing polluting liquids lost by vehicles in the accident, then he will wash the road platform using a solution of water and specific products 803 (ecological surfactant and molecular chain destroyer). This solution is sprayed using a high-pressure water gun, including a rain jet adjustment, 802, so that the polluting material is removed from the platform, avoiding any slippery condition, and it activates a degradation process of hydrocarbons provided by natural bacteria.

Finally, the resulting emulsion 806 is aspirated and collected in the proper container 807, and then temporarily stocked at the site of the company that made the intervention, before being definitely delivered to special and authorized plants, where they are processed and properly finished.

The power supply, necessary to make the multi-purpose truck 100 work properly, can be directly provided by the engine and/or any other point of energy transmission in the kinematic chain. The extracted energy can be therefore used as a power supply for mechanical, electrical or hydraulic devices.

In case that the multi-purpose truck 100 has a pneumatic circuit previously installed on it, like i.e. in case of trucks equipped for transportation of vehicles, having a mechanical arm or a load platform with variable orientation, then the above energy transmission system can be achieved in a different way.

Figure 4:
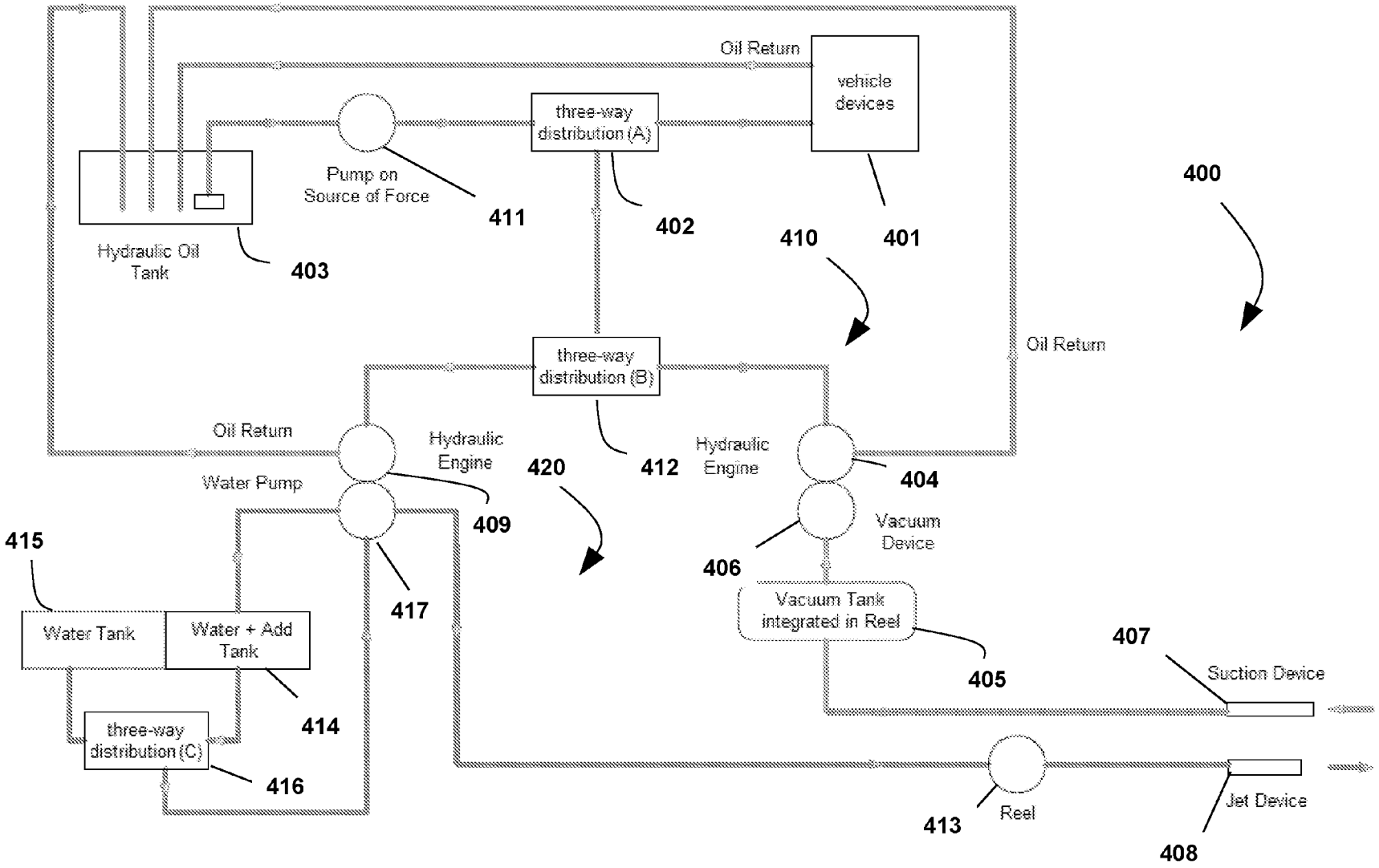
FIG. 4 is a view of a block diagram that represents an improved pneumatic system, installed on trucks of FIGS. 1-2, as a power supply of a high-pressure water gun device, and a device for fast aspiration of liquids.

With reference to FIG. 4, an energy transmission system 400 includes: means for extraction of energy, connected through one or more points of deviation 412 to a primary hydraulic circuit 410 that is previously installed on truck 100, said circuit being typically activated by the engine of the same truck 100; means of energy transmission towards a secondary pneumatic circuit 420 that supplies a high-pressure water gun 408 and a suction system 407.

More in particular, said points of deviation 412 can be represented by a three ways distributor, that takes the energy from oil under pressure in circuit 410, and gives the energy simultaneously to hydraulic engine 409 that supplies water pump 417, and to hydraulic engine 404 that activates the vacuum pump 406. The special washing liquid (ecological surfactant), composed of water, washing powder and/or additional substances for treatment of the road platform (molecular chain destroyer, of oil and oil related products), is contained, in its final composition, inside tank 414. The hydraulic pump 417 pushes and directs the high-pressure liquid from tank 414 towards water gun 408, where it is sprayed outside on the road platform, under control of the operator. The vacuum pump 406 extracts air from tank 405, creating a vacuum state inside, so that the suction system 407 can remove, under control of a second operator, the resulting emulsion from the road platform towards tank 405.

The removed liquids are a mix of the previous washing liquids and other liquids and polluting materials having origin in petroleum, eventually lost by vehicles involved in the accident.

In a different embodiment, another additional tank 415 is installed, connected through a three ways distributor 416, that contains clean water. This additional quantity of water can be useful in order to dilute the sprayed solution, or to alternate different steps of cleaning, with special substances and without them.

Therefore, with the above described systems the truck 100 results to be completely autonomous, from an energetic point of view, and can directly supply said high-pressure water gun 802 and said system of fast suction of liquids 804, without any need of an external electric generator.

Once operations of cleaning of road platform and related parts are completed, the operator must update the information, using the same tablet PC 300 available on the truck 100, in order to put in the data base:

- intervention form, with reference to arrival time on site, and departing time from site; description of the activities related to intervention;
- digital photos of the accident area.

In case it is required, instead, the clearance of the territory, because some big dispersions have occurred, or some dangerous or toxic materials have been lost in the environment, situations as described in the Italian law 334/1999 (Seveso), the Headquarter further contacts the most qualified companies in the country, usually operative partners of the organization.

At the end of the operations, the data base is updated with the following information:

- intervention form related to involved persons in the accident and activities provided by operators;
- accident report, realized by Police officers, with reference to activities performed in order to return practicable road conditions, to manage the emergency of people and vehicles, and to collect the usual identity and measurement data;
- for relevant accidents, some special reports prepared by experts with reference to general situation and activities provided by operators;
- digital photos of the accident area.

As previously explained, after the cleaning procedures, the emulsion contained in tank of truck 100 is temporary stocked at the site of the company that made the intervention, before being definitely delivered to special and authorized plants, where they are processed and properly finished.

An innovative feature of truck 100, is that it includes a specific system, alerting the incoming drivers about the dangerous traffic conditions. This system is composed of: four visual signaling devices with a yellow blinking light, to be placed on ground, in order to signal the obstacle on the road, in case of night intervention or low visibility conditions; a visual signaling device, having a yellow blinking light, or having a blue blinking light, according to the type of authorization obtained; and an acoustic signaling device.

The acoustic signaling device is connected to a proximity sensor, and it is able to detect the approaching of a vehicle that is potentially dangerous for all the persons staying in the area of the accident: the operators responsible for returning it to safe traffic conditions, the Police officers, the workers of mechanical emergency, and the same people of vehicles that have been involved in the accident. When a new vehicle is arriving, the system is automatically activated and generates an acoustic alarm signal, that is diffused around by loudspeakers installed on the same truck 100. According to different embodiments, the alarm signal can be diffused by a pocket device and/or earphones, so that the persons can be alerted immediately about the danger and have the time to run to a safe place.

Another important feature of the present invention is that the same computing and communication means, i.e. tablet PC 300, are available to operators on truck 100, as a remote control for the intervention devices.

In example, operators can control remotely the above instruments of high-pressure water gun 802 and suction system 804, that are eventually integrated with computers, or they can control emergency signaling means, and other devices for pulling and/or lifting vehicles, usually installed on trucks for transportation of vehicles.

All these operations can be done remotely using the same tablet PC 300, where functions of supervision and control are embedded, with reference to specific intervention devices; the same tablet PC 300 comprising: a user interface, preferably with touch screen, means for data acquisition from sensors and detectors; means for data processing; means for control of engines and actuators; and means for data radio transmission.

In order to support any possible emergency and assistance to people involved in car accidents, or natural disasters, the truck 100 further includes a set of boxes and housings, particularly suitable to contain medical emergency material, like i.e.: medical emergency box; first aid medicines; defibrillator; a small oxygen cylinder for asthmatic people; thermic cover; a bottle of water, etc.;

Therefore, the above examples show that the present invention achieves all the proposed objectives. In particular, it permits obtainment of a multi-purpose truck supporting the activities addressed to re-establish safe and practicable road conditions, through cleaning of the area involved in car accidents, by aspiration of the functional liquids lost by vehicles, and collection of the solid debris related to the same involved vehicles.

The same invention includes an internal system for generation and transmission of energy, necessary as a power supply for a high-pressure water gun device and a fast aspiration of liquids device, so to avoid the need to carry an external electric generator, with its drawbacks concerning additional weight and size.

Furthermore, the above said high pressure water jet device and fast liquids aspiration device are integrated and designed in such a way that they result in being efficient and at the same time they take a small amount of space, so that they can be transported and used in a very comfortable way.

Again, according to the invention, the equipment of the truck includes a system for signaling dangerous situations, i.e. due to the activities of operator and to vehicles that are stopped in the center of the road; this system protects everybody who is travelling through the area, and the persons involved in the operations of returning the road to safe traffic conditions.

Furthermore, the equipment of the truck includes computing means and means for a real time communication with an operative Headquarter, said means embedding functions of:

- driving the operator to the exact site of accident, according to the quickest route;
- immediate recognition of the risk factor of the event, according to detection of R.I.N. codes (Risk Identification Number) and O.N.U. codes (related to the identification of the product);
- communication to the operative Headquarter of the need for a special intervention by skilled operators available on the territory, especially in case of accidents involving products, materials or substances that are dangerous, infective and/or toxic;

transmission to the operative Headquarter of digital images related to the accident, so that workers of the same Headquarter can understand exactly the situation and can take make the proper decisions;

reporting the completed activities of intervention, with storage of the technical and photographic documents related to the accident;

communication to the operative Headquarter of the current geographic position of the truck, so that it can be visually represented on each terminal or on a main screen, and can give a constantly updated reference of the operative situation in a specific national area.

Furthermore, the same computing and communication means embed the additional function of providing supervision and control, or remote control, of intervention devices on truck, like i.e. high-pressure water gun, suction systems, emergency signaling means, and other devices for pulling and/or lifting vehicles.

The present invention has been described for illustrative but not limitative purposes, according to its preferred embodiments, but it is clear that modifications and/or changes can be introduced by those skilled in the art without departing from the relevant scope, as defined in the enclosed claims.

The invention claimed is:

1. A Multi-purpose truck for re-establishment of safe and practicable road conditions, after car accidents, through cleaning of the road platform, said truck comprising:

tanks containing clean water; a washing/treatment solution including water mixed to a special washing liquid and a special treatment liquid for the road platform; and an emulsion obtained by collection of the washing/treatment solution and the polluting oil materials lost by vehicles as a consequence of the car accident;

a high-pressure water gun, including a rain jet adjustment, providing a jet of the washing/treatment solution on the road platform, where the polluting oil materials were lost by vehicles;

a suction system suitable to remove the emulsion from the road platform, as well as remove from the road platform solid and not biodegradable debris from the car accident being related to typical car equipment;

wherein the tanks containing the emulsion and the removed solid debris are be stocked at the site of a company that made the intervention, before delivery to special and authorized plants, where they are processed and finished according to specific operative procedures; and said multi-purpose truck including an energy transmission system having:

a primary hydraulic circuit having been originally installed on the truck and being activated by an engine of the truck;

a secondary pneumatic circuit that supplies the high-pressure water gun and the suction system; and one or more points of deviation connected to the primary hydraulic circuit and the secondary pneumatic circuit, the points of deviation configured to transfer power from the primary hydraulic circuit to the secondary pneumatic circuit, wherein the points of deviation comprise a three-way distributor that takes the energy from oil under pressure in the primary hydraulic circuit and transfers the energy simultaneously to a first hydraulic engine that supplies a water pump, and to a second hydraulic engine that activates the vacuum pump, the water pump pushes and directs the high-pressure washing/treatment solution from one of the tanks towards the water gun, where the washing/treatment solution is sprayed outside on the road platform, under control of the operator; and the vacuum pump extracts air from one of the tanks, creating a vacuum state inside said tank, so that the suction system can remove, under control of a second operator, the resulting emulsion from the road platform towards the tank.

2. Multi-purpose truck for re-establishment of safe and practicable road conditions, after car accidents, through cleaning of the road platform, according to previous claim 1 wherein the washing/treatment solution comprises: water, an ecological surfactant, and a molecular chain destroyer; and the washing/treatment solution is contained, in its final composition, inside said tanks, thereby not having to provide individual tanks for each component in the washing/treatment solution.

3. Multi-purpose truck for re-establishment of safe and practicable road conditions, after car accidents, through cleaning of the road platform, according to claim 1, further comprising:

an additional tank, connected through a three ways distributor, that contains clean water; this additional quantity of water can be useful in order to dilute the sprayed solution, or to alternate different steps of cleaning, with special substances and without them.

4. Multi-purpose truck for re-establishment of safe and practicable road conditions, after car accidents, through cleaning of the road platform, according to claim 1, further comprising:

computing means and means for a real time communication with an operative Headquarter, said means embedding a function of satellite navigator, where a geographic map is represented with indicated the current position of the truck and the position of the site of the accident; and driving the operator to the exact site of the accident, following the quickest route.

5. Multi-purpose truck for re-establishment of safe and practicable road conditions, after car accidents, through cleaning of the road platform, according to claim 1, further comprising:

computing means and means for a real time communication, with an operative Headquarter, said means embedding a function of immediate recognition of the risk factor of the event, according to detection of R.I.N. codes (Risk Identification Number) and O.N.U. codes (related to the identification of the product), and with access to a data base including the list of known dangerous goods, with reference to their chemical-physical features and the proper procedures of their treatment, with a further list of industrial plants able to provide treatment of that specific dangerous materials, with their location on the national territory.

6. Multi-purpose truck for re-establishment of safe and practicable road conditions, after car accidents, through cleaning of the road platform, according to claim 1, further comprising:

computing means and means for a real time communication, with an operative Headquarter, said means permitting to operators the supervision and control, or remote control, of the instruments available on truck, like the high-pressure water gun, the suction system, the emergency signaling means, and other devices for pulling and/or lifting vehicles; said computing means comprising: a user interface, preferably with touch screen, means for data acquisition from sensors and detectors, means for data processing; means for control of engines and actuators; and means for data radio transmission.

7. Multi-purpose truck for re-establishment of safe and practicable road conditions, after car accidents, through cleaning of the road platform, according to claim 6 wherein said computing and communication means are represented by one or more mobile phones of the latest generation, connected through the mobile telephone network, or the satellite or wireless telecommunication networks, said phones being able to send/receive text messages, audio/video clips, e-mails and digital photos.

8. Multi-purpose truck for re-establishment of safe and practicable road conditions, after car accidents, through cleaning of the road platform, according to claim 1, further comprising:

computing means and means for a real time communication, with an operative Headquarter, said means embedding a function of reporting, through access to a data base, the completed activities of intervention, with storage of the technical and photographic documents related to the accident.

9. Multi-purpose truck for re-establishment of safe and practicable road conditions, after car accidents, through cleaning of the road platform, according to claim 8 wherein said computing and communication means are represented by one or more personal computers, tablet PCs, or PDAs, connected to the internet, through the mobile telephone network, or the satellite or wireless telecommunication networks, said computers being able to send/receive multimedia content, through FTP, web server, and electronic mail.

10. Multi-purpose truck for re-establishment of safe and practicable road conditions, after car accidents, through cleaning of the road platform, according to claim 1 further comprising emergency signaling means, composed of:

an acoustic signaling device connected to a proximity sensor, said device is able to detect the approaching of a vehicle that is potentially dangerous for all the persons staying in the area of the accident.

11. Multi-purpose motor vehicle for re-establishment of safe and practicable road conditions, after car accidents, through cleaning of the road platform, according to claim 1, further comprising:

a set of boxes and housings, particularly suitable to contain medical emergency material, available to support any possible emergency and assistance to people involved in car accidents, or natural disasters, like i.e.: medical emergency box; first aid medicines; defibrillator; a small oxygen cylinder for asthmatic people; thermic cover; a bottle of water, etc.

12. A Multi-purpose truck for re-establishment of safe and practicable road conditions, after car accidents, through cleaning of a road platform, said truck comprising:

a tank containing clean water;

a tank containing a washing/treatment liquid including water mixed with a special washing liquid and a special treatment liquid for use on the road platform;

a tank containing an emulsion obtained by collection of the washing/treatment liquid after it has been mixed with a polluting oil material; said emulsion containing tank being capable of being temporarily stored at a location and then delivered to a second location for treatment in accordance with environmental laws;

a high-pressure water gun, said gun being capable of spraying the washing/treatment liquid on the road platform whereby the washing/treatment liquid is mixed with the polluting oil material and the emulsion is created;

a suction system suitable for removing the emulsion from the road platform after it is created;

a primary hydraulic circuit connected to the truck, said hydraulic circuit having been originally installed on the truck for a different purpose and being activated by an engine of the truck;

a secondary pneumatic circuit that supplies the gun and the suction system, the pneumatic circuit being connected to and powered by the hydraulic circuit; and a three-way distributor connected to the primary hydraulic circuit and the secondary pneumatic circuit, the three-way distributor configured to transfer power from the primary hydraulic circuit to the secondary pneumatic circuit, wherein the three-way distributor takes energy from oil under pressure in the primary hydraulic circuit and transfers the energy simultaneously to a first hydraulic engine that supplies a water pump, and to a second hydraulic engine that activates a vacuum pump, the water pump pushes and directs the high-pressure washing/treatment liquid from one of the tanks towards the water gun, where the washing/treatment liquid is sprayed outside on the road platform, under control of the operator; and the vacuum pump extracts air from one of the tanks, creating a vacuum state inside said tank, so that the suction system can remove, under control of a second operator, the resulting emulsion from the road platform towards the tank.

13. A Multi-purpose truck for re-establishment of safe and practicable road conditions, after car accidents, through cleaning of a road platform, said truck comprising:

a tank containing a washing/treatment liquid including water mixed with a special washing liquid and a special treatment liquid for use on the road platform;

a tank containing an emulsion obtained by collection of the washing/treatment liquid after it has been mixed with a polluting oil material; said emulsion containing tank being capable of being temporarily stored at a location and then delivered to a second location for treatment in accordance with environmental laws;

a high-pressure water gun, said gun being capable of spraying the washing/treatment liquid on the road platform whereby the washing/treatment liquid is mixed with the polluting oil material and the emulsion is created;

a suction system suitable for removing the emulsion from the road platform after it is created;

a primary hydraulic circuit connected to the truck, said hydraulic circuit having been originally installed on the truck for a different purpose and being activated by an engine of the truck;

a secondary pneumatic circuit that supplies the gun and the suction system, the pneumatic circuit being connected to and powered by the hydraulic circuit;

a tank containing clean water, the tank containing clean water being connected to the tank containing the washing/treatment liquid by a three-way distributor, whereby this additional quantity of clean water can be used to dilute the sprayed washing/treatment liquid, or to alternate the spraying of the washing/treatment liquid with the clean water by the gun.

* * * * *